US006359272B1

(12) United States Patent
Sadek et al.

(10) Patent No.: US 6,359,272 B1
(45) Date of Patent: Mar. 19, 2002

(54) MICROWAVE PACKAGE AND SUPPORT TRAY WITH FEATURES FOR UNIFORM CRUST HEATING

(75) Inventors: Nagwa Zaki Sadek, Ypsilanti, MI (US); Mark Elliot Ingelin, Bennington, KS (US); Alan Carl Ebeling; Erica Ann LaBarge, both of Salina, KS (US); Kathleen Gail Roy, Minneapolis, KS (US)

(73) Assignee: Schwan's Sales Enterprises, Inc., Marshall, MN (US)

( * ) Notice: Subject to any disclaimer, the term of this patent is extended or adjusted under 35 U.S.C. 154(b) by 0 days.

(21) Appl. No.: 09/714,065

(22) Filed: Nov. 16, 2000

Related U.S. Application Data

(63) Continuation-in-part of application No. 09/330,556, filed on Jun. 11, 1999.

(51) Int. Cl.[7] ..... H05B 6/80

(52) U.S. Cl. ..... 219/732; 219/734; 219/735; 219/730; 99/DIG. 14; 426/118; 426/234

(58) Field of Search ..... 219/732, 730, 219/734, 735, 762; 99/DIG. 14; 426/107, 114, 113, 115, 118, 234, 243

(56) References Cited

U.S. PATENT DOCUMENTS

| | | | | |
|---|---|---|---|---|
| 4,096,948 | A | | 6/1978 | Kuchenbecker |
| 4,190,757 | A | | 2/1980 | Turpin et al. |
| 4,260,060 | A | | 4/1981 | Faller |
| 4,267,420 | A | | 5/1981 | Brastad |
| 4,283,424 | A | | 8/1981 | Manoski et al. |
| D273,168 | S | | 3/1984 | Bowen et al. |
| 4,450,334 | A | | 5/1984 | Bowen et al. |
| 4,567,341 | A | | 1/1986 | Brown |
| 4,592,914 | A | | 6/1986 | Kuchenbecker |
| 4,641,005 | A | | 2/1987 | Seiferth |
| 4,745,249 | A | * | 5/1988 | Daniels ..... 219/735 |
| 4,785,160 | A | * | 11/1988 | Hart ..... 219/735 |
| 4,834,995 | A | | 5/1989 | Canzoneri |
| 4,870,233 | A | | 9/1989 | McDonald et al |
| 4,877,932 | A | | 10/1989 | Bernstein et al. |
| 4,896,009 | A | | 1/1990 | Pawlowski |
| 4,915,780 | A | | 4/1990 | Beckett |
| 4,927,991 | A | | 5/1990 | Wendt et al. |
| 4,970,360 | A | | 11/1990 | Pesheck et al. |
| 5,012,061 | A | | 4/1991 | Lesser |
| 5,077,455 | A | | 12/1991 | Peleg et al. |
| 5,132,144 | A | | 7/1992 | Parks |
| 5,217,765 | A | | 6/1993 | Parks |
| 5,231,268 | A | | 7/1993 | Hall et al. |
| 5,247,149 | A | | 9/1993 | Peleg |
| 5,288,962 | A | | 2/1994 | Lorence et al. |
| D344,875 | S | | 3/1994 | Pomroy et al. |
| 5,482,724 | A | | 1/1996 | Morici et al. |
| 5,565,125 | A | | 10/1996 | Parks |
| 5,585,027 | A | | 12/1996 | Young |
| D383,358 | S | | 9/1997 | Hassen |
| 5,900,264 | A | * | 5/1999 | Gics ..... 426/107 |

OTHER PUBLICATIONS

Photograph, Laminated Paperboard Tray –Compartmentalized Container.
Photograph, Round Microwave Plastic Container.
Photograph, Microwave Pizza Tray—Bottom View.
Photograph, Microwave Pizza Tray—Top View.
Photograph, Microwave French Fry Container.
Photograph, Plain Paperboard Packaging.

* cited by examiner

*Primary Examiner*—Philip H. Leung
(74) *Attorney, Agent, or Firm*—Merchant & Gould P.C.

(57) ABSTRACT

Disclosed is a microwave cooking package and tray suitable for cooking food. The package and tray comprise a laminate structure comprising a lid, susceptor layer upon a backing material, and a plurality of apertures through said laminate structure. This permits uniform cooking and browning of dough enrobed food items and venting of excess moisture to help to control heat generation under the food being cooked, as the apertures remove a portion of the susceptor material.

8 Claims, 11 Drawing Sheets

MICROWAVE PACKAGE AND SUPPORT TRAY WITH FEATURES FOR UNIFORM CRUST HEATING

RELATED APPLICATIONS

This application is a continuation-in-part of the co-pending patent application Ser. No. 09/330,556 filed Jun. 11, 1999.

FIELD OF THE INVENTION

The invention relates generally to heat generating and supporting devices used in baking food items having a dough crust. Such devices include a package having a closure and tray or platform suitable for use during cooking and more specifically include closure and tray or platform devices suitable for use in baking processes in microwave ovens. More specifically, the invention relates to microwave cooking packages which enclose the food item on all sides and are capable of heat generation and heat control during baking methods. More specifically, the invention is directed to microwave cooking packages which are designed to obtain even and effective heat generation for all dough surfaces.

BACKGROUND OF THE INVENTION

Microwave ovens differ substantially from conventional radiant heating ovens in their heating mechanism. In a conventional radiant oven, heat energy contacts the exterior surface of the food and its container during cooking. The heat energy moves inward as the food cooks. Consequently, food cooked in a conventional oven is typically hotter on the exterior and cooler in the center. Convection ovens, in which air circulation is improved via an integral fan placed in front of the heat source, is similar to a conventional oven. Of course, cooking times in a convection oven may be lower due to its improved heat transfer characteristics.

In microwave cooking, polar molecules (such as water) in the food adsorb microwave energy and release heat. Microwave energy typically penetrates further into the food than does heat energy and heats water molecules throughout the food. Water may be expelled from the food resulting in a dry texture. On the other hand, if water vapor is not dissipated, the food tends to become soggy. In either case, the food develops an unpalatable texture. There is a need for a package for food, especially dough enrobed food items, which conveniently enables cooking in a microwave oven without adversely affecting taste or texture.

Further, the air temperature within the microwave oven is substantially lower than conventional ovens. Microwave ovens can also have a hot spot or spots characteristic of uneven energy distribution in the oven. As a result, foods cooked in a microwave oven are often warmer in unpredictable positions. As a result, it is more difficult to obtain the surface temperatures necessary for Maillard and other browning reactions. To attain the necessary temperatures and to insure even baking in a microwave oven, the food must be heated to greater temperatures. In order to solve this problem, the use of susceptor materials has gained favor.

Conventional susceptor materials are well understood and are typically incorporated in packaging that is heated by incident microwave energy. Typically, in microwave cooking applications, a suitable susceptor material is placed as a layer upon a packaging substrate such as paper or paperboard. Typical susceptor materials include a thin layer of particulate metal such as aluminium. These are referred to as metallized susceptors. Other susceptor materials are classified as non-metallized, and include materials which can be sprayed, coated or printed onto the paper or paperboard substrate. Susceptor materials have had problems in the past, such as development of hot spots and runaway heating.

A problem which remains involves cooking frozen rising dough pizza crusts. While a certain amount of heat is necessary to cook and brown the crust, excessive heat generation underneath the crust can result in puffing or ballooning of the uncooked or partially cooked crust during baking. This can cause uneven cooking and can cause toppings to become dislodged, or even fall completely off the pizza. Further, this ballooning or puffing can be considered very undesirable by the ultimate consumer.

A second cause of ballooning or puffing is excess gas or water vapor generation during baking. Previous attempts at ventilation have been directed to cooking food such as pizzas within a cardboard or paperboard box which has one or more ventilation holes provided in packaging positioned above or around a heated food item. Examples of this include Kuchenbecker, U.S. Pat. Nos. 4,096,948 and 4,592,914. However, these patents both describe structures in which the food is placed inside, rather than atop the structure. This does nothing to vent the underside of the cooking pizza crust. A two part carton for handling and cooking food items wherein the top panel of the carton has a microwave reflective layer to shield food contents from microwaves and provides for venting moisture between edges of the upper and lower parts of the carton is disclosed by Brown, U.S. Pat. 4,567,341.

Further, these patents are silent as to the problem of excessive or uneven heat generation by microwave energy impinging on a susceptor layer. Attempts have been made to control heat generation. One method of doing so is to use an electrically conductive or "reflective" shield which limits the amount of microwave energy which is permitted to impinge on the susceptor material. Examples of this technique include Turpin, U.S. Pat. No. 4,190,757; and Lorence et al., U.S. Pat. No. 5,288,962. These are complicated, multi-piece devices, however.

Brastad, U.S. Pat. No. 4,267,420 describes a plastic wrap having a very thin coating thereon which controls microwave conductivity when a wrapped food item is cooked in a microwave oven. The wrap contacts all surfaces of the food item and does not provide for release of water vapor formed during cooking.

Bowen et al., U.S. Pat. No. 4,450,334 describes a cooking utensil suitable for baking pizza combining a microwave conductive pan mounted on a microwave transparent base having a separate microwave conductive cover removably supported by the base. The utensil does not form part of a package suitable for storage and handling of food items. The utensil is intended to provide uniform heating of pizza during microwave baking.

Peleg et al., U.S. Pat. No. 5,077,455 discloses an open-ended sleeve receptacle for microwave browning and crisping of a food item. The sleeve is made from microwave susceptor stock. The sleeve does not expose all sides of the food item to a susceptor surface. Further, the sleeve is intended to be assembled immediately prior to microwave cooking and is not suitable as a package for storage and handling of food items.

Another attempt at controlling heat generation is exhibited by Wendt et al., U.S. Pat. No. 4,927,991, in which an intact susceptor layer is used in conjunction with an electrical conductive grid. The grid serves to diffuse, or evenly distribute incoming microwaves. Specifically, this allows for control of the relative amounts of reflected, transmitted and absorbed power when used in with the suspected layer. However, this is a multi-piece structure. Further, the grid taught by Wendt fails to address the issue of venting.

Consequently, a need remains for a simple, easy to operate, package and cooking tray suitable for cooking foods such as frozen pizza and dough enrobed food items in a microwave oven which provides uniform browning of dough crust and venting of moisture so that the crust bakes without becoming soggy.

SUMMARY OF THE INVENTION

Accordingly, the invention is found in a microwave cooking package and tray suitable for cooking food. The package is particularly suited for cooking food items comprising a dough crust which must be baked and/or browned. The package comprises a laminate structure having a base forming a tray providing a food contact surface, a wall surface defining a cavity disposed on the base and a lid shaped and configured to rest on the wall and enclose the cavity wherein the laminate structure comprises a susceptor layer upon a backing material. A plurality of apertures are spaced through the laminate structure in an effective water vapor dissipating pattern. The package also has supports to provide a space between the package and the surface upon which it rests to dissipate water vapor. The pattern of apertures and the vertical supports cooperate to heat and vent the food being baked. Further, the apertures reduce the amount of the susceptor material and control direct heating.

In a preferred embodiment, the invention is found in a one piece package having a hingedly connected lid suitable for cooking food items by microwave heating such that the food item is enclosed on all sides by a susceptor layer. The lid has a latching tab positioned to cooperatively interact with a slot in a wall of the package to fix the lid in place when closed. The closed package provides dough enrobed food items with sufficient moisture during baking to maintain a chewy texture while the susceptor layer exposes the surface of the food item to substantially uniform heat to provide a brown and crispy crust. The tray structure on which the food item rests has a plurality of apertures. The apertures dissipate water vapor released from the portion of the food item in contact with the tray thereby reducing the tendency for dough at the interface with the tray to blister or balloon. The lid may also have one or more apertures to dissipate moisture released by particularly moist food items such as those comprising sauces and gravies.

In another preferred embodiment, the lid and base are not connected prior to assembling to form a package for cooking food items in a microwave oven. The base is a one piece tray having side walls defining a cavity disposed on the base. A plurality of apertures are spaced through the tray in a pattern effective to dissipate water vapor. The tray also has fold out verticle supports to provide a space between the package and a support surface in the microwave oven to aid with dissipating water vapor. The lid has two or more locking tabs configured to mate with locking slots in the base when the lid is positioned to form a package. A food item is placed on the tray formed in the base, the lid is positioned on the base and the tabs are inserted into the slots to hold the lid in place during storage, transportation and handling. The lid and base form a package having a laminate structure. The laminate structure comprises a susceptor layer upon a backing material. The package exposes all sides of a food item to a susceptor surface during cooking to promote uniform browning of crust surfaces.

In another preferred embodiment, the invention is found in a one piece cooking tray suitable for cooking food in a microwave oven having a oven floor, wherein the tray comprises a laminate structure comprising a susceptor layer upon a backing material, the laminate structure comprising a portion that can be formed into a support that can maintain the susceptor layer at a distance of at least about 4 millimeters from the oven floor; and a distribution of apertures through said laminate structure. The apertures are sufficient to permit venting and to control heat generation under the food being cooked.

DETAILED DESCRIPTION

Figure 1:
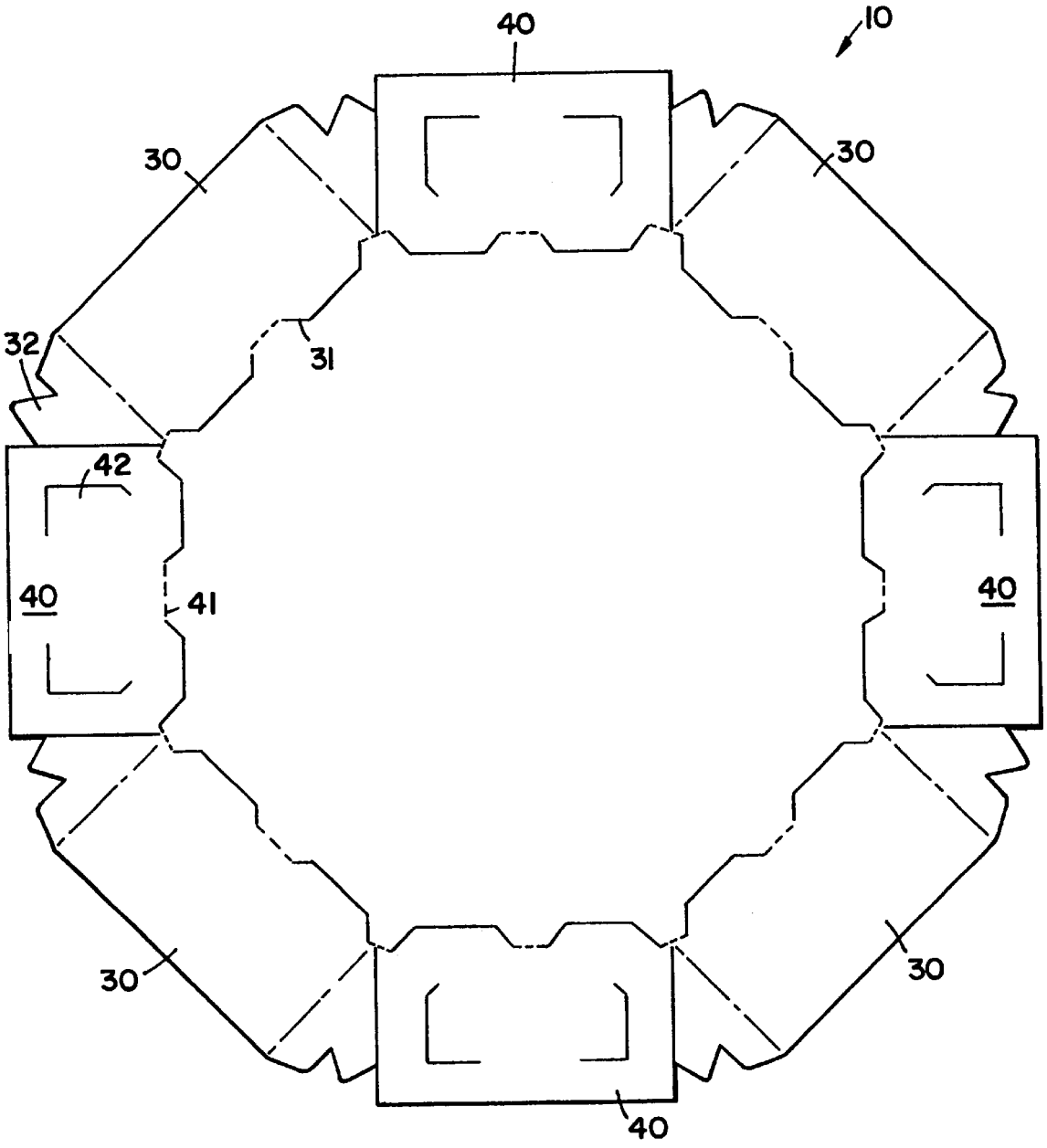
FIG. 1 (PRIOR ART)
FIG. 1 is a top plan view of a typical pizza tray known in the art. Note that this tray does not have apertures in the tray surface for ventilation or for control of heat generation.

Convenience food items for cooking in a microwave oven frequently comprise a dough crust. For example, pizzas comprise a dough crust, a tomato-based pizza sauce, one or more cheeses, and possibly one or more toppings such as sausage, pepperoni, onions, olives, and the like. Pizzas can be made in the home from individual ingredients, ordered out or taken out from a restaurant or pizzeria, or obtained frozen. Pizza may be frozen prior to any baking or can be frozen after being partially baked. Pizzas which are frozen can then be taken home by the consumer and heated when desired. Commercially prepared products such as frozen pizza will often contain one or more preservatives in order to obtain a longer shelf life.

Probably the most complex portion of a pizza, whether fresh or frozen, is the crust. Typical pizza crusts comprise a bread-like dough having large proportion of flour and water which is kneaded and rolled into a typically relatively round shape of variable thickness. There may be one or more rising (proofing) steps prior to rolling. Sometimes, dough undergoes several rising/kneading cycles before it is ready to roll out into the desired shape and size. Dough forms when the flour and water interact to form gluten, which forms when hydrated flour particles are manipulated. Glutens (there are several types) are the wheat proteins which provide much of the structure of dough products. This is a complicated process which is not completely understood.

Along with flour and water, doughs may contain salt, sugar, other seasonings, preservatives and one or more leavening agents. Leavening agents can be chemical or biological. Typical examples of chemical leavening agents include baking soda, which interacts with an acid source present in the dough, and baking powder, which is a self-contained leavening agent containing both dry soda and dry acid which react together upon dissolution in water. In this instance, soda is typically defined as sodium bicarbonate, although other compounds such as monocalcium phosphate and sodium aluminum sulfate are also useful. In any event, the acid and soda react to form carbon dioxide; which is a gas which provides the necessary leavening. Conversely, a typical biological leavening agent is yeast, which consists of cells of selected strains of the microorganism *Saccharomyces cerevisiae*. As the cells metabolize sugars (present in the dough) under anaerobic conditions (common within doughs), carbon dioxide is evolved.

Typically, most pizzas can be classified as either thin crust or deep dish. A thin crust pizza has a crust which is about 2 to 5 millimeters in thickness near the center and a thickness of about 4 to 7 millimeters near the edge. In contrast, a deep dish pizza has a crust which is typically about 13 to 16 millimeters thick near the center and about 26 to 32 millimeters thick near the crust edge. As the pizza becomes thicker, the difficulties associated with microwave cooking increase. Pizzas typically have fillings which are approximately 80 percent water, while most crusts contain about 30 percent water. This discrepancy has led to many of the difficulties in past attempts to cook pizzas in microwave ovens. The use of susceptor layers, as previously discussed, has lessened these difficulties.

A similar food item is a "stuffed pizza" wherein a dough layer is applied over the toppings after the typical open-face pizza has been assembled. A stuffed pizza is an example of a category of food items referred to as "dough enrobed" whereby dough completely surrounds a filling. Dough enrobed food items include sandwich-like products having fillings including for example and without limitation hard cooked eggs, cheese, sausage, vegetables, meats, fish, stew preparations and the like. Dough enrobed food items also include pastries which may be filled with jam, jelly or other confections. Microwave cooking of a dough enrobed food item requires cooking conditions which permits the dough to bake to a chewy bread like consistency while browning the dough surface to form a crispy crust. A package comprising susceptor layers surrounding the food item on all sides exposes the dough surface to a substantially uniform heat for browning. Further, the package encloses the food item to maintain moist surroundings to reduce the tendency for the dough to desiccate as it bakes thereby forming a chewy, bread like texture. The package also has one or more apertures to allow some moisture to vent to the atmosphere to avoid having the cooked dough becoming soggy. The number, size and location of the apertures can vary with the food item and its moisture content and are readily determined by a person of ordinary skill.

Laminate Structure

The microwave cooking package and tray of the invention comprises a laminate structure with at least two layers. The laminate structure includes a paperboard substrate with a susceptor layer imprinted or adhesively attached to the substrate. The laminate structure is created by combining together the paperboard layer, susceptor layer and any other optional layers via a dry adhesive bond. Since the tray provides support and will contact food items, the laminate structure may also include a food contact surface as the top layer.

The substrate layer preferably comprises solid bleached sulfite paperboard which is about 0.5 millimeters thick. Alternatively, the preferred paperboard can be described as being of 105# weight, or 16 point, for example. Paperboard has several features which make it ideal for microwave applications. It is strong, easily handled, and microwave invisible. Paperboard can easily be printed with suitable graphics and text. Further, paperboard can absorb moisture when exposed to steam. Most importantly, paperboard is structurally and dimensionally stable when exposed to microwave energy. This means that paperboard retains its original length, width and thickness. In contrast, polyester substrates, for example, have a tendency to shrink and shrivel when exposed to microwaves.

A variety of paper sources can be used, provided they meet certain minimum strength and performance parameters, including a reduced level of moisture absorption during storage, low shrinkage and enhanced strength and integrity.

The paperboard may be coated to enhance smoothness, brightness or structural integrity. A coating may also be used to enhance the paperboard's ability to accept ink, or to resist moisture. A preferred coating is clay, or even clay mixed with a sodium silicate. This is an area in which one of skill in the art can easily experiment and select coatings.

The laminate structure also comprises a susceptor material, which absorbs a certain portion of the impinging microwave energy and subsequently undergoes heating. Possible susceptor materials include metallic substances such as aluminum. Preferred, however, are the non-metallic, ink-based susceptor materials. More preferred susceptor materials include water glass (sodium silicate) with fine graphite particles dispersed within it. These ink-based materials can be directly printed onto the paperboard substrate, which is a substantially simpler process than laminating a thin metallic layer onto the substrate, or forming a thin metallic layer via vapor deposition. Preferably, the metallized polyester susceptor material is about 40 to 80 gauge, preferably about 48 gauge. Susceptor materials are often classified by their resistance. Preferably, the microwave cooking package and tray of the invention has a resistance of about 150 to 200 ohms per square.

The laminate structure may optionally further comprise a food contact surface. Suitable materials for this layer must be stable at temperatures as high as about 400° F. (about 204° C.) and must meet Food and Drug Administration guidelines for food contact use. Examples of suitable materials include various acrylics and silicones. Preferably, the material used will impart a sufficient level of release properties, so that the pizza will easily release from the tray after cooking. Preferred materials include silicone which is applied at a rate of 3 pounds per 500 sheets of 24 by 36 inch paperboard (which translates to a rate of 1 pound per 1000 square feet, or about 0.049 kilograms per square meter).

The laminate structure used in the microwave cooking package and tray of the invention has a number of venting apertures placed within it. In one embodiment, the susceptor layer can be formed as a single integral layer on the paperboard substrate. The apertures are then cut through the entire laminate structure at the same time. Typically, the apertures would be punched out, preferably by a machine which could create all of the apertures in a single tray at one time. This is not required, of course, as the apertures could also be formed individually.

In another embodiment, the susceptor layer is formed having voids in each future aperture location. If the susceptor material used is ink-based, this can easily be accommodated in the printing process used to create the susceptor layer. Once the voids are formed, the paperboard layer can be punched out without cutting through the susceptor layer. Preferably, the voids are of the same shape as the apertures and are slightly larger in diameter. Preferably, the voids and apertures are both circular.

The microwave cooking package and tray described by the invention is easily used by the consumer. Typically, the cooking package and tray and frozen food item is contained inside a larger paperboard or plastic overwrap to protect the food item from damage during storage, shipping and handling. The consumer can open the overwrap and extract the frozen food item and cooking package and tray. The food item may be further wrapped in a plastic material for further protection. This is an optional layer which is easily removed by the consumer.

In a preferred embodiment, the frozen food item is packaged within the assembled cooking package and tray. The consumer has only to remove the cooking package and tray assembly containing the food item from any additional packaging material. Placement the food item within the cooking package and tray also means that the food item is entirely surrounded by susceptor material. Preferably, the susceptor material is present above, beneath and around the perimeter of the food item being cooked. This aids in providing a uniformly browned crust.

The cooking package and tray is typically assembled on the packaging line but may be pre-assembled if desired. The tray has a scoring pattern which allows the packaging machine to easily fold down a number of support pieces which include complementarily shaped mating ends which can be interwoven to form a wall providing a cavity on the tray which can support the food item such as pizza at a distance which is at least about 4 millimeters above the oven floor. This minimum distance is important for adequate ventilation. In the case of a frozen pizza, cooking occurs in a microwave oven at high power for a time period of about 3 to 5 minutes. Typical microwave ovens have high power ratings which range from about 800 to about 1500 watts. For example, a particular large microwave oven sampled had a power rating of 1350 watts. At the end of the cooking period, the pizza has typically reached a temperature of about 85° C. in the crust and a temperature of about 80° C. in the filling or sauce.

DETAILED DESCRIPTION OF DRAWINGS

The one piece microwave cooking tray of the invention comprises a tray with a distribution of apertures in the tray that cooperate with the tray and supports to heat, bake and vent steam from the pizza. Such a combination bakes the pizza uniformly without hot spots or unwanted puffing of the dough. Trays used for cooking frozen pizzas in microwaves are well known in the art. A typical example is shown in FIG. 1, which is a top plan view of a pizza tray 10, shown in its flat, unassembled configuration. Generally, the pizza tray 10 has a flat surface 20 sized for a particular pizza. The pizza tray 10 also has a number of folding sections 30 and 40, respectively, which interlock to form a raised tray. In the tray 10 shown, each segment 30 has, at each end, a locking tab 32. Correspondingly, each segment 40 has, at each end, a locking slot 42. When received by the appropriate folding machine, pizza tray 10 is assembled to form legs and walls for support of the food during cooking. This is accomplished by bending up each segment 30 along line 31 and each segment 40 along line 41. Once these segments 30 and 40 are bent over and creased, they can be locked together via previously described locking tabs 32 and locking slots 42.

Figure 2:
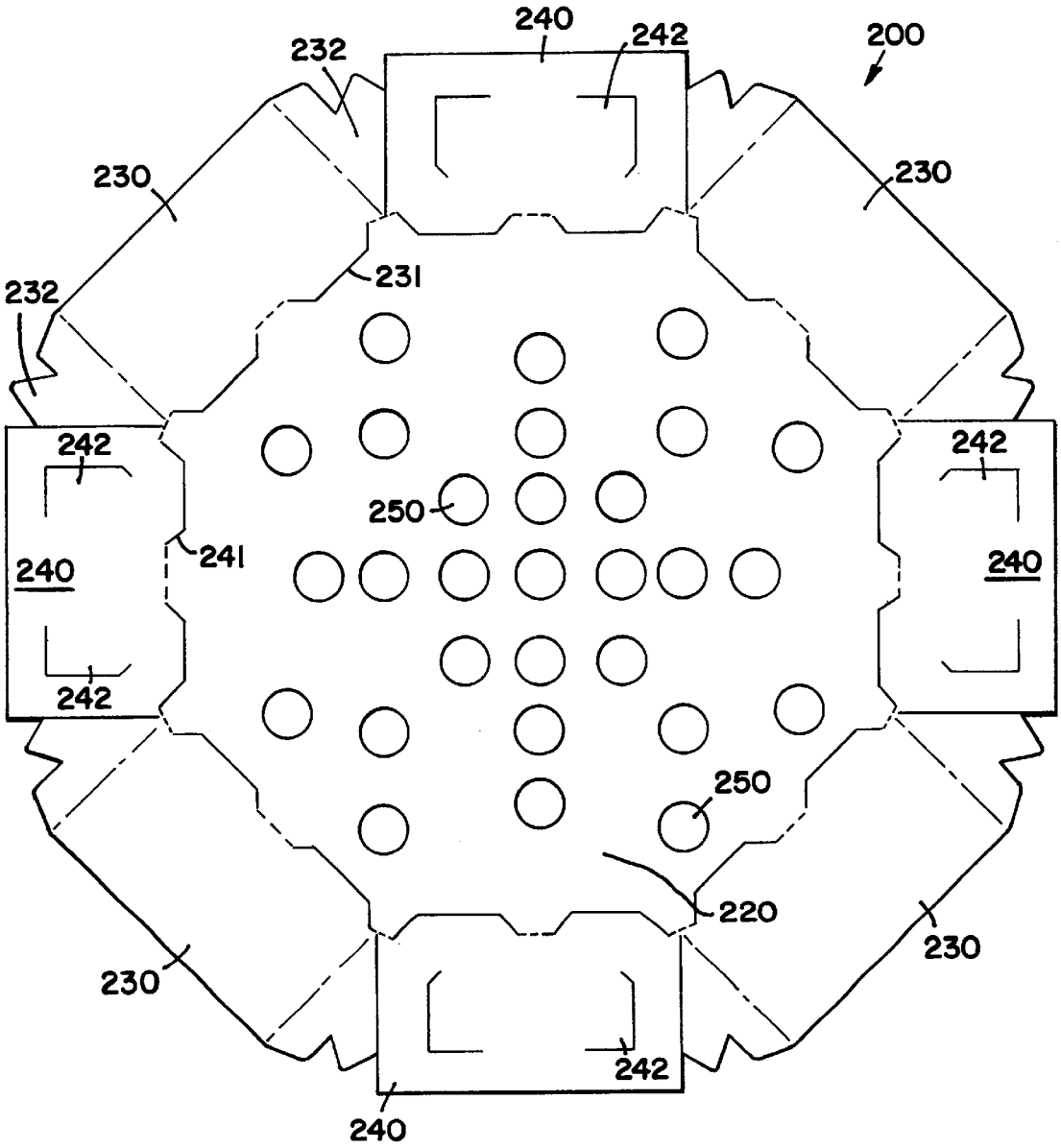
FIG. 2 is a top plan view of the one piece microwave cooking tray of the invention, having supports and a preferred distribution of apertures in the tray bottom for ventilation, steam release and heat generation control. The supports are shown in a coplanar position with respect to the tray and are not folded into a support orientation.

We have found that by placing a plurality of apertures in the bottom of a pizza tray, one can provide even, effective baking with ventilation and controlled heat generation. Combined, these features allow a pizza to cook properly without ballooning. An embodiment of the invention is shown in FIG. 2. FIG. 2 is a top plan view of an embodiment of the invention, shown in its flat, unassembled form. Pizza tray 200 has a top surface 220 and a plurality of folding segments 230 and 240. A key feature of pizza tray 200 is the location, pattern and number of venting apertures 250. Preferably, these venting apertures 250 are about 0.3 to 1.1 centimeters, preferably about 0.5 to 0.9 centimeters in diameter. The tray typically has about 6 to 12% of its total area in the form of apertures. The preferred distribution of apertures involves decreasing number of apertures from the center to the edge of the tray. The best test for this distribution is to measure the distance from one aperture to the next nearest aperture for a sufficient set of apertures to test the pattern sufficiently. If the distance to the nearest aperture is greater at or near an edge aperture when compared to a pair of apertures selected at or near the center, then the pattern is in the preferred distribution.

Assembly of the tray 200 is much the same as that of the prior art tray shown in FIG. 1. Each segment 230 has, at each end, a locking tab 232 which fits into a complementarily shaped locking slot 242 present on each locking segment 240. Each segment is folded up along lines 231 and 241, respectively. Together, lines 231 and 241 form a scoring pattern which permits the packaging machine to easily fold the locking segments 230 and 240 to form the raised tray. Once folded, the tray has a diameter across its top surface 220 of about 120 to 200 millimeters, preferably about 130 millimeters.

Figure 3:
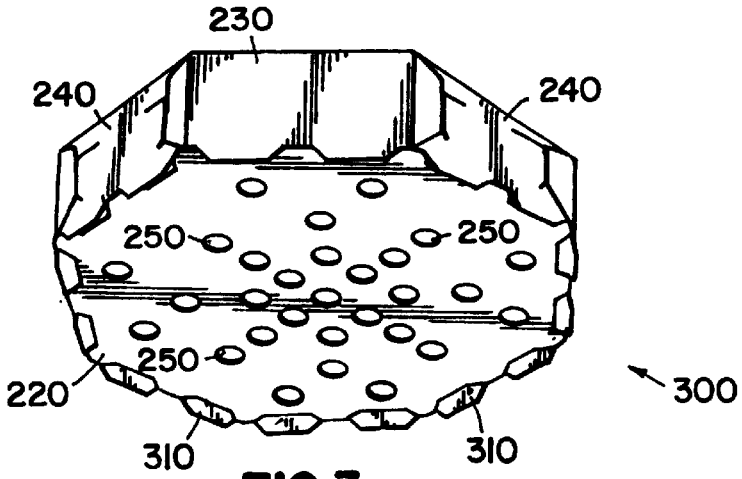
FIG. 3 is a bottom perspective view of the one piece microwave cooking tray of the invention, shown in its folded, ready-to-use configuration.
Figure 6:
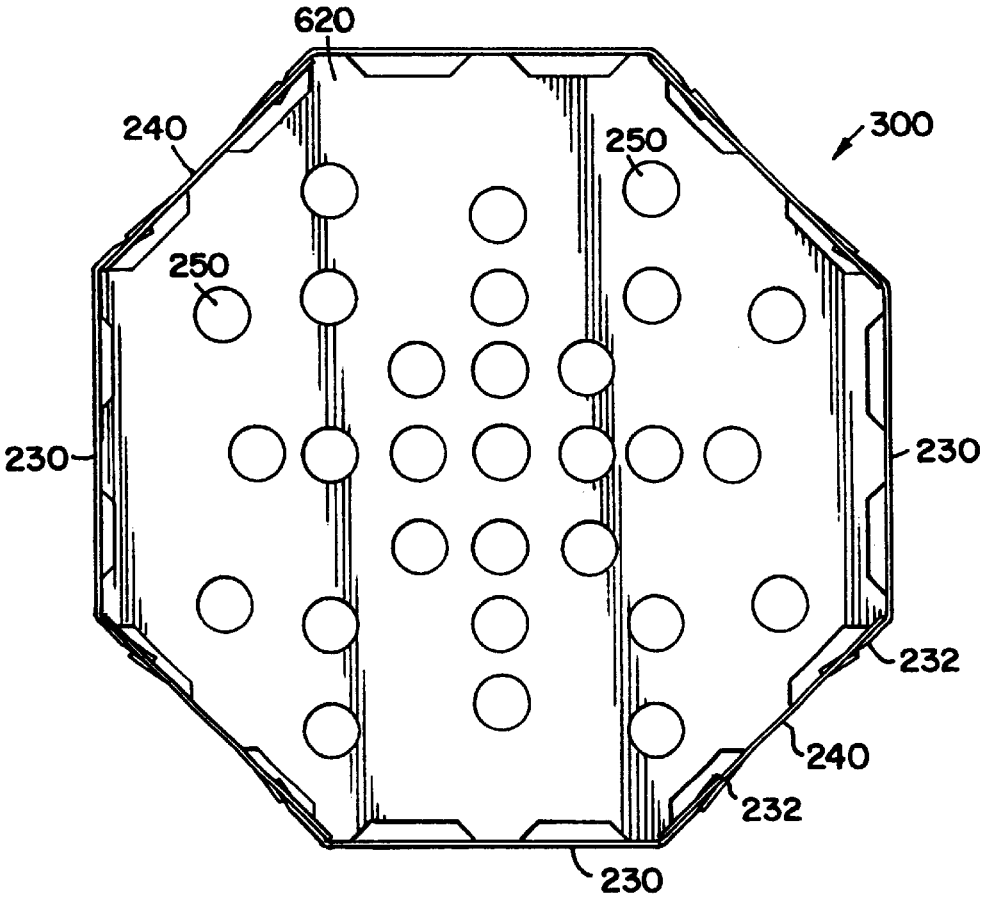
FIG. 6 is a bottom plan view of the same the one piece microwave cooking tray.
Figure 5:
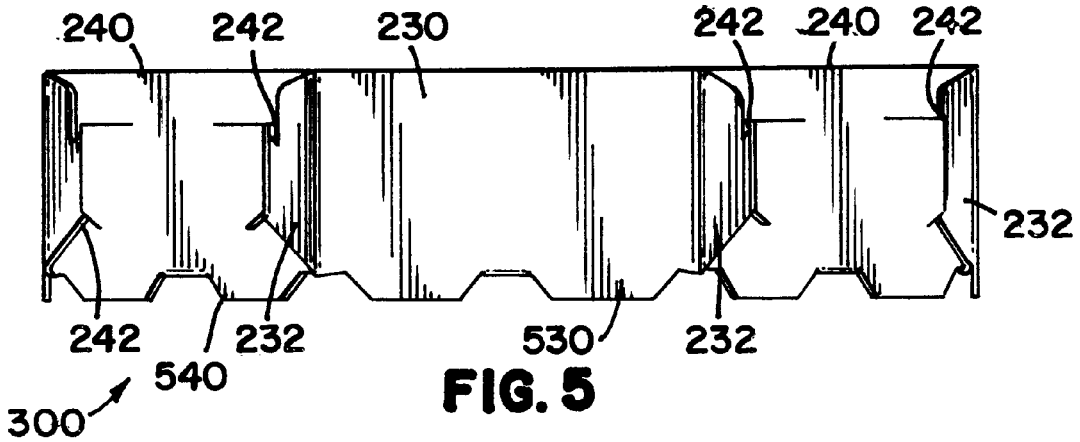
FIG. 5 is a side elevation of the same one piece microwave cooking tray, showing how the side components interlock to form the raised tray.
Figure 4:
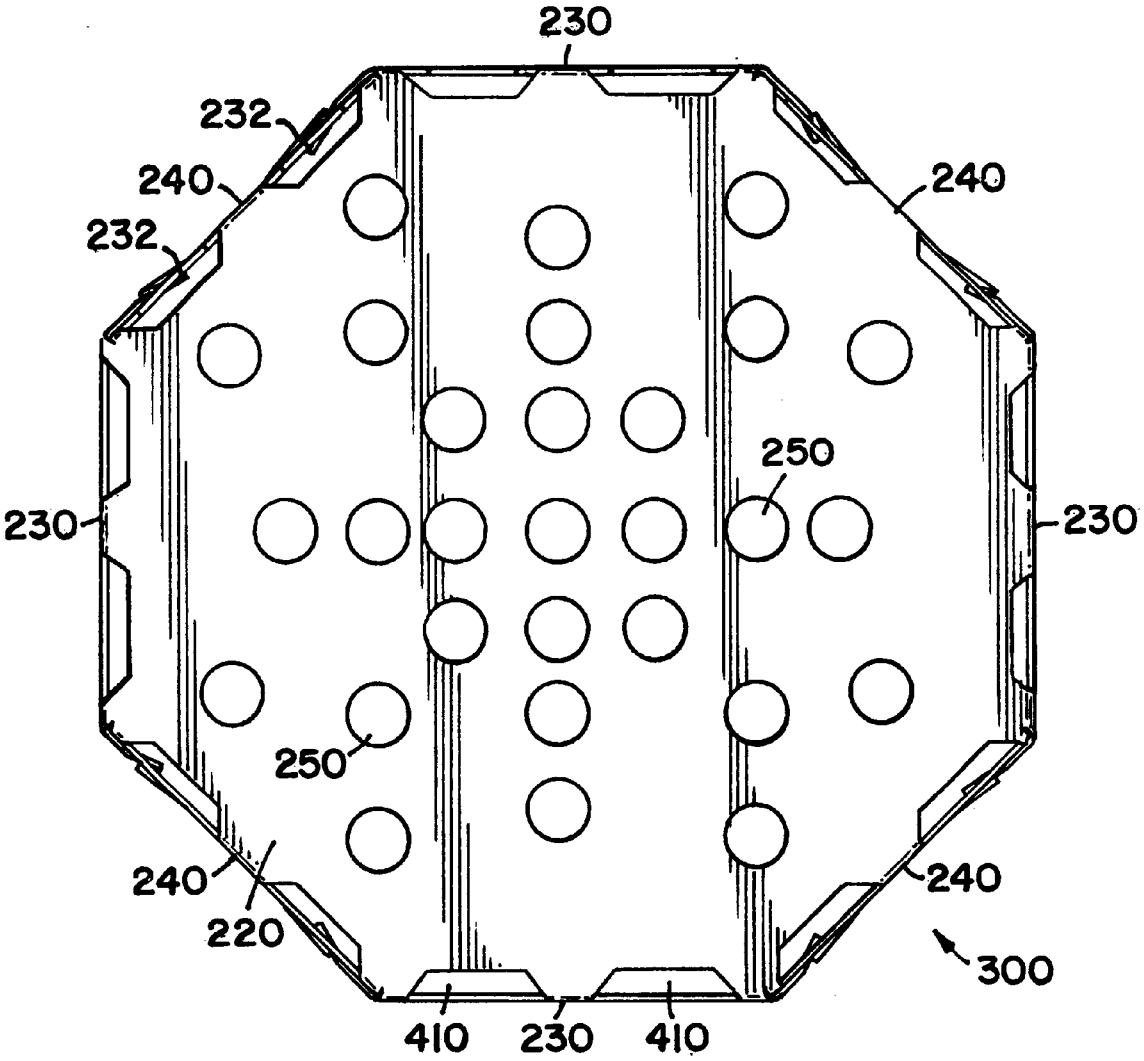
FIG. 4 is a top plan view of the one piece microwave cooking tray shown in FIG. 3.

FIGS. 3–6 show the pizza tray 300 in its folded configuration. FIG. 3 is a perspective view of pizza tray 300, while FIGS. 4 and 5 are top plan and side elevation views, respectively. These Figures show, in detail, how the locking segments 230 and 240 interact to form a raised tray 300. This is best seen in FIG. 5, which shows a locking segment 230 and several locking segments 240. Locking segments 230 and 240, once interconnected, form walls 530 and 540, respectively. Walls 530 and 540 extend about 20 to 35 millimeters, preferably about 28 millimeters above the flat, food holding surface 220 of the tray 300. These walls 530 and 540 serve to provide (via susceptor material) heat generation in proximity to the edges of the pizza while also preventing the pizza from sliding off the tray 300 during handling. The locking segment 230 is shown with locking tabs 232, which are engaged in the corresponding locking slot 242 present in the adjacent locking segment 240. Each locking segment 230 and 240 are, once assembled, about 45 to 60 millimeters, preferably about 45 millimeters, in width.

An important feature of the pizza tray 300 of the invention is seen in FIG. 3. Once the pizza tray 300 has been assembled, a portion of locking segments 230 and 240, along lines 231 and 242, respectively, form raised portions 310 on the pizza tray 300. It is raised portions 310 which provide the desired elevation of at least about 4 millimeters.

The embodiment of the pizza tray 300 of the invention described in the drawings uses interlocking tabs and slots to secure locking segments 230 and 240 together. This is not required, however. In an alternate embodiment not shown, locking segments 230 and 240 can be glued together using any suitable adhesive. In this case, locking tabs 232 and the corresponding locking slots 242 would be replaced with adhesive bonds.

Figure 7:
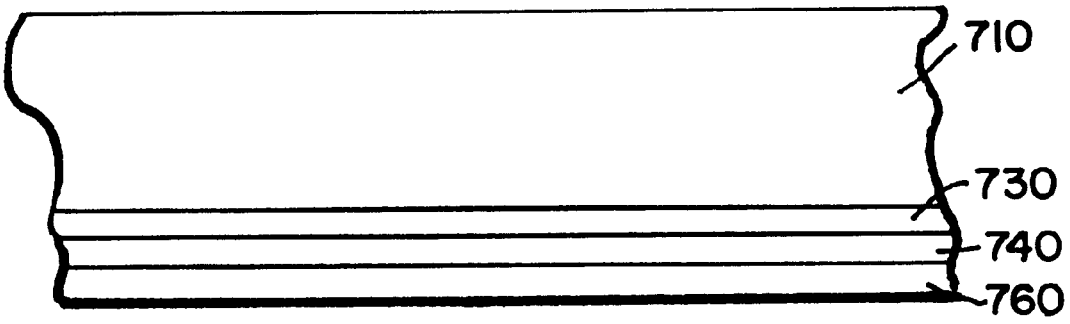
FIG. 7 is a cross-sectional side view of the laminate structure of the one piece microwave cooking tray of the invention.

FIG. 7 demonstrates the laminate structure of the microwave cooking package and tray of the invention. It is important to remember that the individual layers can be rearranged without substantially effecting the performance of the laminate structure. Further, one of skill in the art will realize that additional layers could also be present. These possible layers include adhesion resistance layers and thermal protection layers. In the particular embodiment shown in FIG. 7, the first layer is the paperboard substrate layer 760. Next is the susceptor layer 740. Optional protective layer 730 is next. Atop the laminate structure is the pizza 710.

Figure 8:
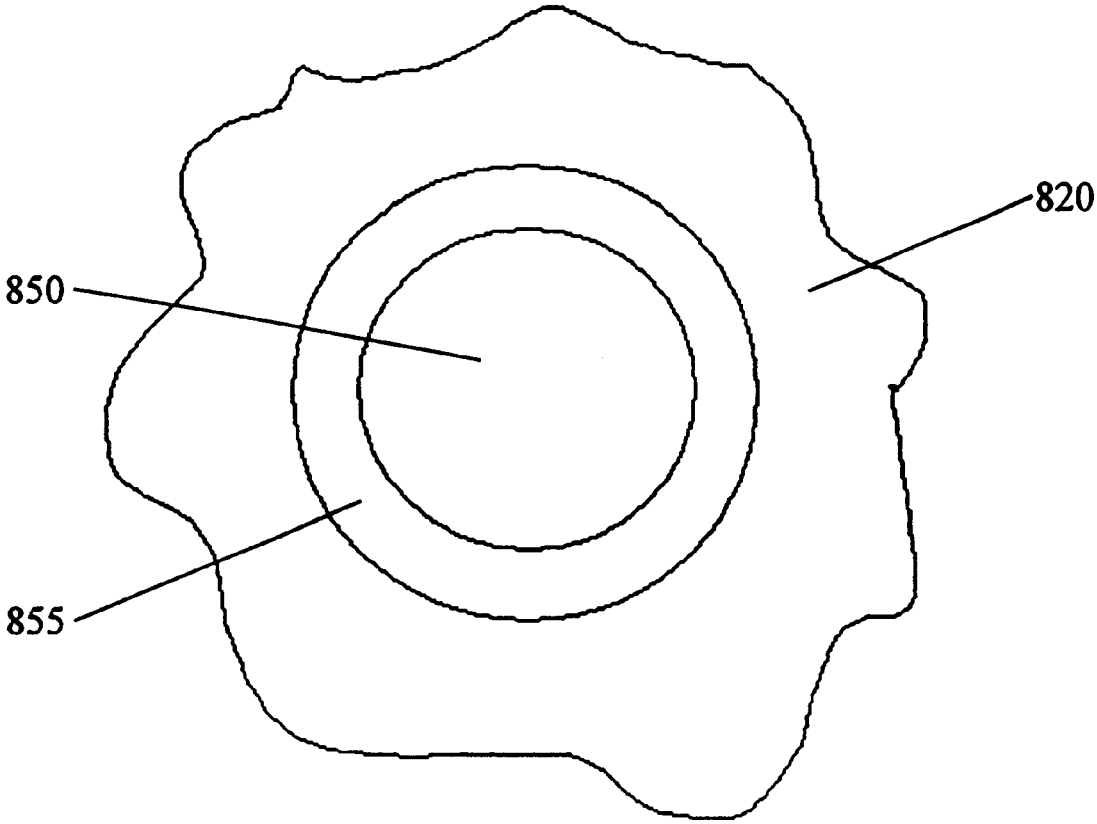
FIG. 8 is an enlarged view of another embodiment of the one piece microwave cooking tray of the invention, showing that voids can be formed in the susceptor layer prior to creating the apertures in the paperboard.

Finally, FIG. 8 demonstrates another embodiment of the invention in which the apertures are formed in a multi-step process. Pictured is a single aperture 850 located within a single void 855. Preferably, all of the apertures present in the pizza tray are of this structure. Instead of cutting through all of the laminate layers at the same time, a void 855 is created within the susceptor material 820. Preferably, void 855 is formed in a printing process used to apply an ink-based susceptor material. After void 855 is formed, aperture 850 is formed within void 855.

Preferably, aperture 850 is of the same shape as void 855 but is of slightly smaller size. This will permit formation of the apertures 850 without cutting into susceptor material 820. Doing so can possibly cause susceptor material to leach out of the laminate structure and into the food being cooked. As discussed, apertures 850 are preferably about 0.5 to about 0.9 millimeters in diameter. Consequently, voids 855 are preferably about 0.9 to 0.13 millimeters in diameter.

The invention also comprises a package having a lid shaped and configured to rest on the wall of the tray. When the lid is in a closed position, the cavity formed by the wall and base of the tray is substantially enclosed on all sides. The lid may be hingedly connected to a wall segment or it may be separately formed and attached to the tray by interlocking tabs and slots, adhesive or other suitable attachment means. In either case, the lid is made from microwave susceptor material to expose all surfaces of a food item to a susceptor surface. The lid may have one or more locking tabs to fix the lid in place on the base. The tabs are configured to mate with locking slots in the tray.

Figure 9:
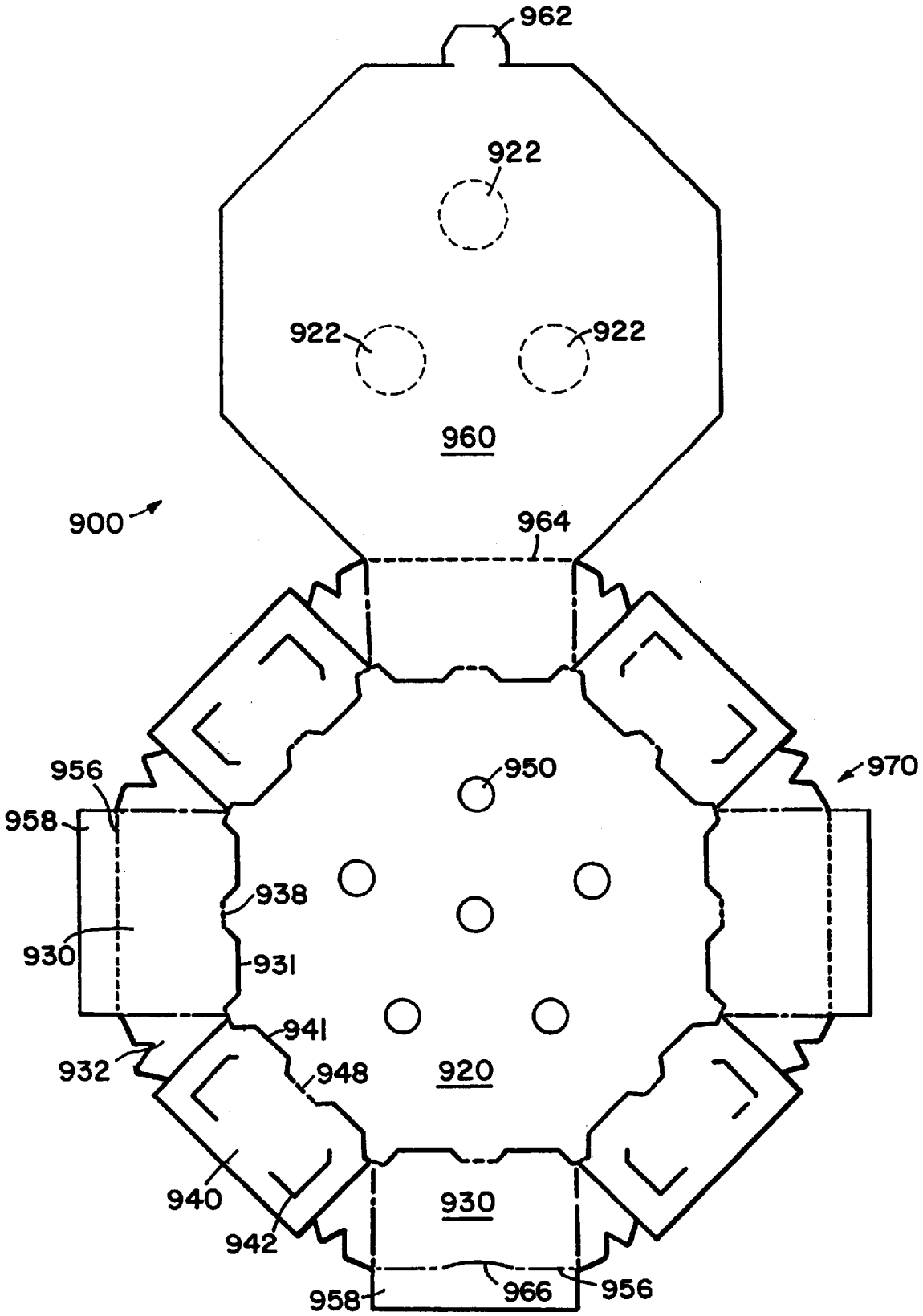
FIG. 9 is a top plan view a one piece laminate structure of the invention prior to assembly as a microwave cooking package having a lid with a locking tab, walls, supports and apertures in the tray bottom.

FIG. 9 is a top plan view of the invention as a one piece package 900 in an unfolded configuration. Generally, the package 900 comprises a tray 970 and a lid 960. The tray 970 has a flat base surface 920 providing a food contact surface for receiving a food item (not shown). The base 920 has a plurality of apertures 950 for venting water vapor during cooking. The apertures 950 may vary in number, size and location in the base 920 depending on the requirements of the food item contained in the package 900. Preferably, the apertures 950 are about 0.3 to 1.1 centimeters, and more preferably about 0.5 to 0.9 centimeters, in diameter. The lid 960 may optionally have apertures 922 shown in phantom. The number, size and arrangement of apertures 922 in the lid 960 may be the same or different from the apertures 950 in the base 920. The choice of number, size and arrangement of apertures 922/950 will depend on the moisture dissipating requirements of the food item contained in the package 900 and is readily determined by a person of ordinary skill.

Figure 10:
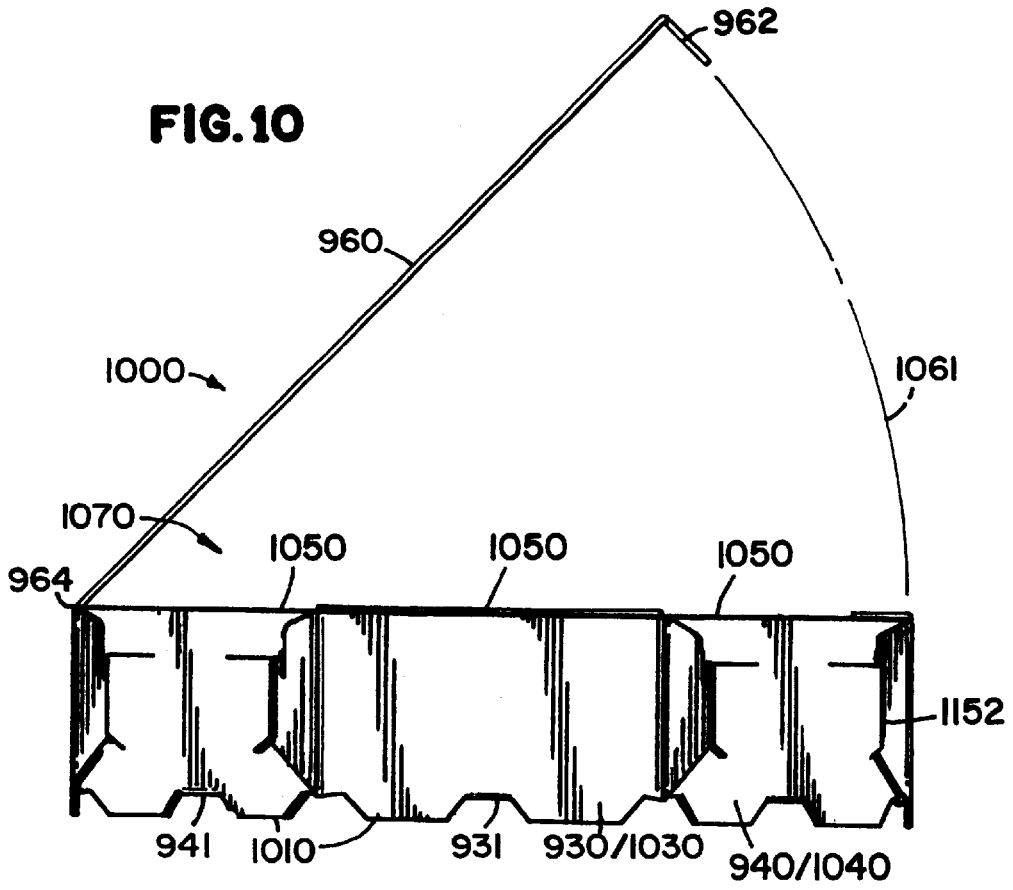
FIG. 10 is a side elevation of the same cooking package after assembly showing how the lid interacts with the side walls of the package and how the side walls interlock to form a cavity.

The tray 970 has a number of folding sections 930,940 which fold along score lines 931/941 to form a wall defining a cavity disposed on the base 920. The folding sections 930/940 are cut and shaped at parting lines 938/948 to form legs 1010 in the folded and assembled package 1000 as shown in FIG. 10. Each segment 930 has a support shoulder 958 foldable along a score line 956 to provide a rest surface for the lid 960 in a closed, fully assembled package. Each segment 930 also has at each end a locking tab 932. Each segment 940 has at each end a locking slot 942 to receive a locking tab 932 to form the wall. The lid is hingedly attached to the tray 970 along a score line 964 to a folding section 930. The lid has a locking tab 962 that mates with a locking slot 966 in a fully folded and assemble package. The locking slot 966 is conveniently located at score line 956 but could be elsewhere in the support shoulder 958 or the folding segment 930 to which the support shoulder 958 is attached.

Figure 11:
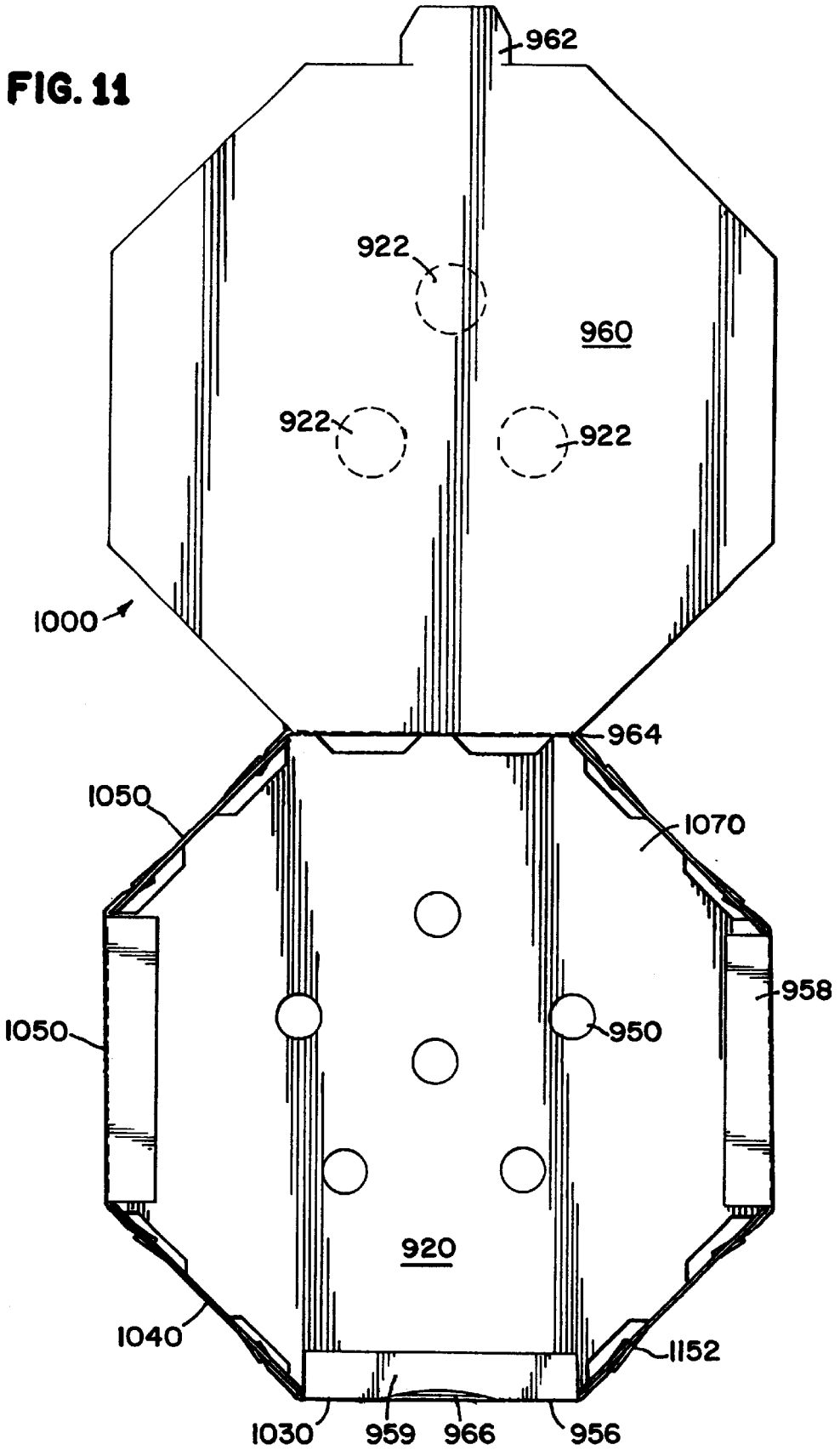
FIG. 11 is a top plan view of the assembled cooking package showing support shoulders for the closed lid and a slot in the support shoulder opposite the lid to receive the locking tab.

FIGS. 10 and 11 show a folded and assembled package. FIG. 11 is a top plan view of a package 1000 with the lid 960 in an open position assembled from the unfolded package configuration 900 shown in FIG. 9. The base 920 has a plurality of apertures 950 which may vary in size, number and location in the base 920. The interlocking wall segments 1030/1040 formed from folding sections 930/940 are attached to the base 920. The wall segments 1030/1040 are held in place by interlocking tabs 932 and slots 942 shown in an interlocked position 1152. The wall segments 1030/1040 form a wall 1050 along the perimeter of the base 920 defining a cavity 1070 for receiving food items. Support shoulders 958 are formed on wall segments 1030. Three support shoulders are illustrated in FIG. 11, but more or fewer could be present within the spirit of the invention. The support shoulders 958 could interchangably be formed on wall segment 1040 as well as wall segment 1030.

A lid 960 is hingedly attached to a wall segment 1030 at a score line 964 with the wall segment 1030. The lid 960 is shaped and configured to cover the cavity 1070 formed by the assembled wall segments 1030/1040 and to enclose a food item (not shown) within the cavity 1070. The lid 960 has a locking tab 962 that interlocks with locking slot 966. The locking slot 966 is preferably formed at the score line 956 between a support shoulder 958 and a wall segment 1030. However, the locking slot 966 could be formed in the support shoulder 958 or in the wall segment 1030 if more convenient for folding and assembling a closed package (not shown). All interior surfaces forming the cavity 1070 are made from susceptor material to provide substantially uniform heat to the food item when cooked in a microwave oven. In the case of dough enrobed items, the dough bakes to a substantially uniform, chewy consistency and forms a brown, crispy crust.

FIG. 10 is a side elevation of a fully assembled package 1000 showing several folding sections 930/940 folded at fold lines 931/941 to form wall segments 1030/1040. The wall segments 1030/1040 are interconnected 1152 by locking tabs 932 inserted in locking slots 942 to form a wall 1050 defining a cavity 1070. The folding sections 930/940 also form legs 1010 at the bottom of the wall segments 1030/1040 to support the package in a raised position. The lid 960 is connected at a hinge 964 formed from a score line 956 with a wall segment 1030. The lid 960 is closed along trajectory line 1061 allowing the locking tab 962 to mate with a locking slot (not shown) formed in an opposing wall to secure the lid 960 in a closed position adjacent the wall segments 1030/1040. This assures that all surfaces of a food item contained in the package 1000 are exposed to a susceptor surface.

Figure 14:
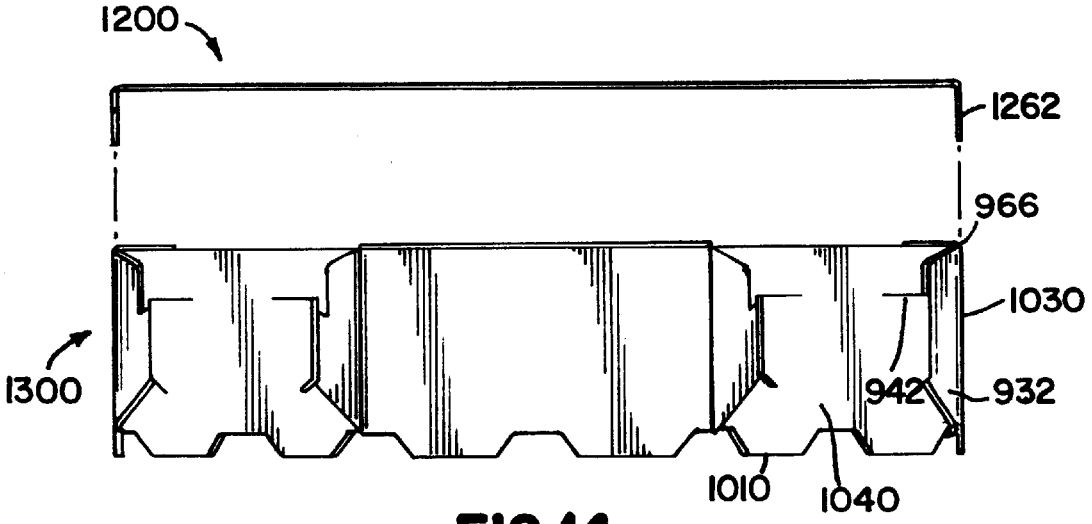
FIG. 14 is a side elevation of the assembled tray with the lid in position for closing the package.
Figure 15:
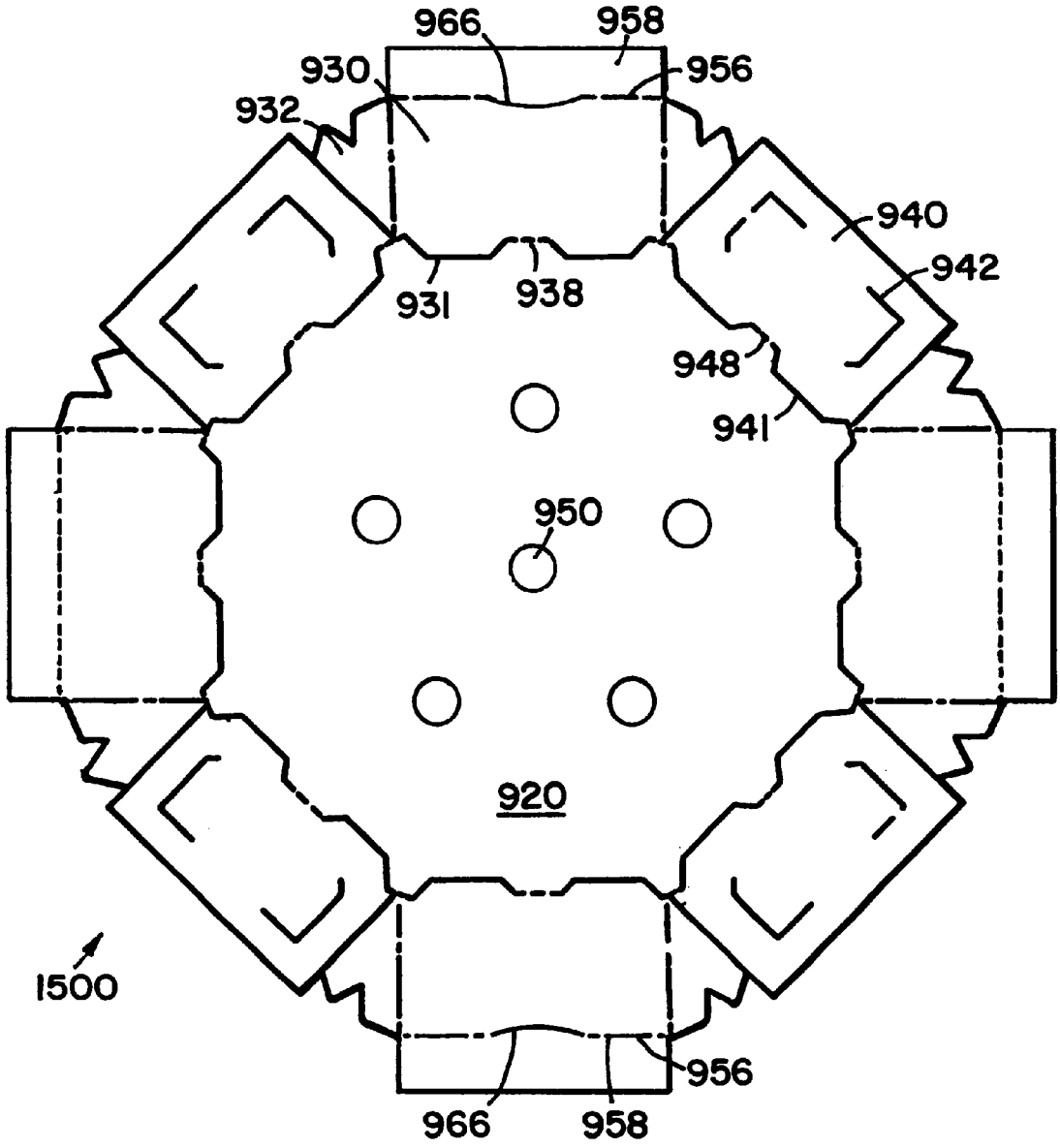
FIG. 15 is a top plan view of the tray part of the two piece package of the invention prior to folding.

FIGS. 12 to 15 show a two piece package having a tray 1300 and a lid 1200. FIG. 15 is a top plan view of the tray 1300 in an unfolded configuration. The tray 1300 is similar to the tray 970 shown in FIG. 9 except that the lid 960 is replaced with a support shoulder 958. Support shoulder 958 is foldable along a score line 956 and has a locking slot 966 suitable to receive a locking tab 1262 from the lid 1200. The locking slot 966 is preferably located at the score line 956. The locking slots 966 shown in FIG. 15 are preferably diametrically positioned in the tray 1300.

Figure 12:
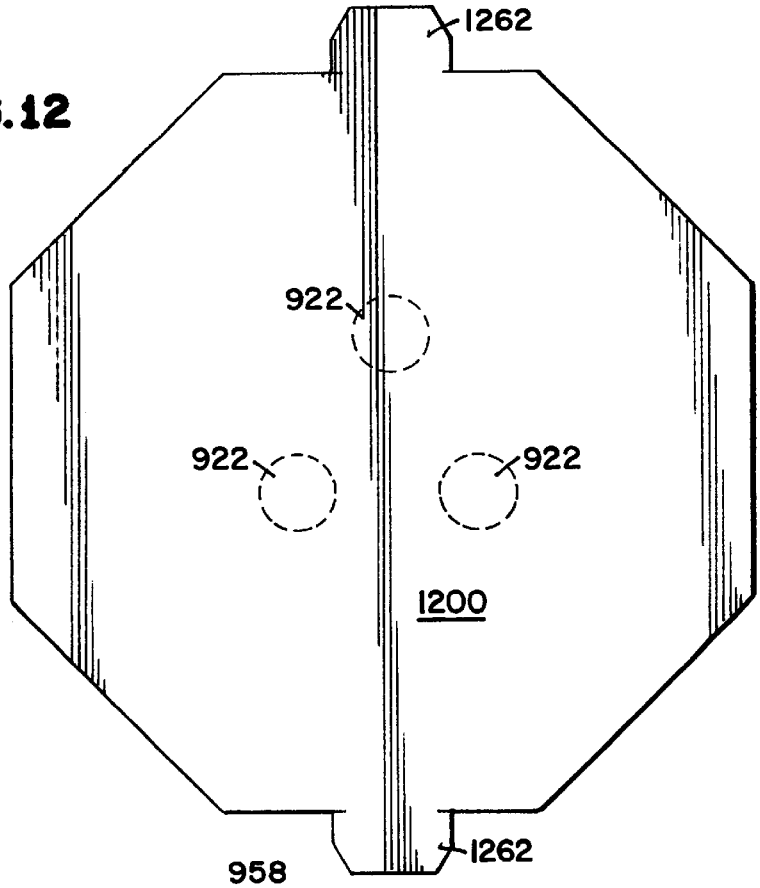
FIG. 12 is a top plan view of the detached lid with locking tabs for a two piece cooking package.

FIG. 12 is a top plan view of a lid 1200 shaped and configured to rest on support shoulders 958 and enclose a cavity 1070 formed by interlocked wall segments 1030/1040 and the base 920 of the tray 1300. The lid has locking tabs 1262 shaped and configured to mate with locking slots 966 in a fully folded and assembled tray 1300. The lid 1200 may optionally have apertures 922 shown in phantom.

Figure 13:
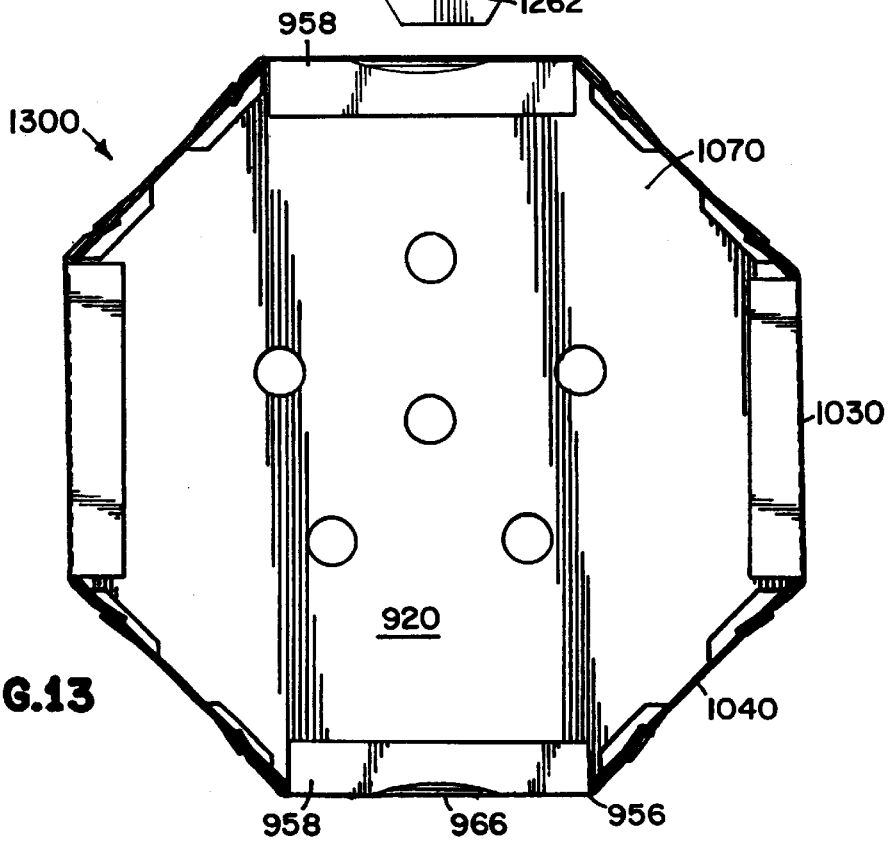
FIG. 13 is a top plan view of the assembled tray for a two piece cooking package.

FIG. 13 shows a top plan view of a folded and assembled tray 1300. The assembled tray 1300 is similar to the tray of FIG. 11 except that the lid 960 in FIG. 11 is replaced with a support shoulder 958 in FIG. 13. The support shoulders 958 are formed on wall segments 1030 along score lines 956. Support shoulders 958 in opposed positions on the perimeter of the tray 1300 have locking slots 966 configured to receive locking tabs 1262 formed of the lid 1200. FIG. 14 shows the tray 1300 positioned to receive a lid 1200 having the locking tabs 1262 folded for inserting into locking slots 966 in the score lines 956 of the support shoulders 958 shown in FIG. 13. A fully assembled and closed package (not shown) results after inserting the locking tabs 1262 into the locking slots 966.

EXPERIMENTAL RESULTS

Tests were conducted comparing the one piece microwave cooking tray of the invention to a conventional cooking tray as shown in FIG. 1. In these tests, identical frozen deep dish pizzas, available from Tony's Pizza Service, were used. Each pizza was cooked at high power for a period of 3.5 minutes in a 900 watt microwave oven. Prior to the tests, each cooking tray was formed by folding down the appropriate support sections.

As expected, the deep dish pizza cooked on the conventional tray lacking apertures exhibited substantial ballooning. The maximum ballooning height was measured at the center of the pizza to be 5 centimeters. In contrast, the deep dish pizza cooked on the microwave cooking tray of the invention exhibited virtually no ballooning. This pizza exhibited a maximum ballooning height of essentially zero.

A second experiment was performed with a dough enrobed, pizza-like snack food item. A pizza filling including tomato sauce, cheese and pepperoni were spread on a pizza rising dough base approximately 3 mm thick. A separate, top dough layer approximately 0.6 mm thick was applied to the filling mixture and the edges of the top and base dough layers pressed together. The dough enrobed food item had a generally circular shape and was approximately 130 mm in diameter and approximately 25 mm thick. The filling to dough weight ratio was approximately 45/55. The assembled food item was enclosed in a one piece microwave cooking package having a lid and was frozen. The frozen food item, enclosed on all side by the susceptor surfaces of the cooking package was cooked at high power for a period of 3.5 minutes in a 900 watt microwave oven. The resulting cooked food item had a crispy brown crust and a chewy texture.

These tests demonstrate that the addition of a particular distribution of apertures through the cooking tray laminate structure serve to adequately vent the crust and to sufficiently limit heat generation under the crust. Further, surrounding a dough enrobed food item with susceptor surfaces enables uniform cooking of the food item to provide cooked item with a crispy brown crust and a chewy texture. The invention exhibits a substantial improvement over the performance of the prior art.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A package suitable for cooking a food item in a microwave oven having an oven floor, the package comprising:

(a) a laminate structure comprising a tray having a base providing a food contact surface, a plurality of wall segments disposed on the base forming a wall surface defining a cavity and a lid free of apertures hingedly connected to one segment of the wall surface wherein the lid provides a closure for the cavity and wherein the laminate structure comprises a susceptor layer upon a backing material;

(b) a support shoulder hingedly connected to a segment of the wall surface other than the segment to which the lid is connected wherein the support shoulder is shaped and configured to provide a rest surface for the lid;

(c) a plurality of apertures formed in the base wherein the apertures are sufficient to permit venting water vapor through the food contact surface; and (d) a support means for the base that separates the base from the oven floor providing a space to dissipate vented water vapor.

2. A package of claim 1 wherein the lid comprises a locking tab shaped and configured to interlock with a locking slot in the tray.

3. The package of claim 2 wherein the locking slot is formed in the hinge between the support shoulder and wall segment.

4. The package of claim 2 wherein the locking slot is formed in a segment of the wall surface.

5. A package of claim 1 wherein the food item comprises a dough enrobed item.

6. A package of claim 5 wherein all surfaces of the food item contained in the package are exposed to a susceptor surface when the lid is in a closed position.

7. A package suitable for cooking a food item in a microwave oven having an oven floor, the package comprising:

(a) a laminate structure comprising a tray having a base providing a food contact surface, a plurality of wall segments disposed on the base forming a wall surface defining a cavity for receiving a food item;

(b) a lid having a plurality of locking tabs shaped and configured to interlock with locking slots in the tray:

(c) a plurality of support shoulders hingedly connected to wall segments configured to receive the lid;

(d) a plurality of apertures formed in the base wherein the apertures are sufficient to permit venting water vapor through the food contact surface; and (e) a support means for the base that separates the base from the oven floor providing a space to dissipate vented water vapor.

8. The package of claim 7 wherein the locking slots are formed in hinges between support shoulders and wall segments and are positioned to receive the locking tabs of the lid.

* * * * *